US009178270B2

(12) United States Patent
Vanjani et al.

(10) Patent No.: US 9,178,270 B2
(45) Date of Patent: Nov. 3, 2015

(54) WIRELESS COMMUNICATION DEVICE WITH A MULTIBAND ANTENNA, AND METHODS OF MAKING AND USING THEREOF

(75) Inventors: Kiran Vanjani, San Diego, CA (US); Balamurugan Shanmugam, San Diego, CA (US)

(73) Assignee: Futurewei Technologies, Inc., Plano, TX (US)

( * ) Notice: Subject to any disclaimer, the term of this patent is extended or adjusted under 35 U.S.C. 154(b) by 335 days.

(21) Appl. No.: 13/604,521

(22) Filed: Sep. 5, 2012

(65) Prior Publication Data

US 2013/0307731 A1 Nov. 21, 2013

Related U.S. Application Data

(60) Provisional application No. 61/648,469, filed on May 17, 2012.

(51) Int. Cl.
*H01Q 1/38* (2006.01)
*H01Q 5/00* (2015.01)
(Continued)

(52) U.S. Cl.
CPC ..... *H01Q 1/243* (2013.01); *H01Q 1/38* (2013.01); *H01Q 5/357* (2015.01); *Y10T 29/49016* (2015.01)

(58) Field of Classification Search
CPC ..... H01Q 5/0003; H01Q 5/001; H01Q 5/00; H01Q 5/0027; H01Q 5/0051; H01Q 5/0055; H01Q 5/0058; H01Q 5/0072; H01Q 5/0075; H01Q 7/00; H01Q 9/0414; H01Q 9/26; H01Q 9/42; H01Q 1/24; H01Q 1/241; H01Q 1/242; H01Q 1/243; H01Q 1/36; H01Q 1/38
USPC ..... 343/700 MS, 702, 741, 866
See application file for complete search history.

(56) References Cited

U.S. PATENT DOCUMENTS 6,459,413 B1 * 10/2002 Tseng et al. ..... 343/702
6,642,893 B1 * 11/2003 Hebron et al. ..... 343/702
7,132,999 B2 * 11/2006 Yamagajo et al. ..... 343/895
(Continued)

FOREIGN PATENT DOCUMENTS

JP 2001332924 A 11/2001
WO 2004032280 A2 4/2004

OTHER PUBLICATIONS

Notification of Transmittal of the International Search Report and the Written Opinion of the International Searching Authority, or the Declaration received on Application No. PCT/CN2013/075828, mailed Aug. 22, 2013, 9 pages.
(Continued)

*Primary Examiner* — Robert Karacsony
*Assistant Examiner* — Patrick Holecek
(74) *Attorney, Agent, or Firm* — Slater & Matsil, LLP

(57) ABSTRACT

An antenna for a wireless device including a meander structure formed from a plurality of meanders and a conductive strip connected in parallel to the meander structure and including a plurality of tabs projecting toward the meander structure, a first group of tabs connected to a first group of meanders corresponding to the first group of tabs, a second group of tabs disconnected from a second group of meanders corresponding to the second group of tabs. In an embodiment, the antenna is incorporated into a wireless device having a transceiver and a finite ground plane.

23 Claims, 11 Drawing Sheets

(51) Int. Cl.
*H01Q 1/24* (2006.01)
*H01Q 5/357* (2015.01)

(56) References Cited

U.S. PATENT DOCUMENTS 7,183,982 B2 * 2/2007 Kadambi et al. ..... 343/702
7,777,677 B2 * 8/2010 Bungo et al. ..... 343/700 MS
8,284,106 B2 * 10/2012 Guan ..... 343/700 MS
2002/0190903 A1 12/2002 Watada et al.
2005/0270243 A1 12/2005 Caimi et al.
2008/0094283 A1 4/2008 Mei
2009/0303144 A1 12/2009 Hirano
2010/0097272 A1 * 4/2010 Kim et al. ..... 343/700 MS

OTHER PUBLICATIONS

Extended European Search Report received in Application No. 13790667.3-1811 mailed Apr. 15, 2015, 11 pages.

* cited by examiner

WIRELESS COMMUNICATION DEVICE WITH A MULTIBAND ANTENNA, AND METHODS OF MAKING AND USING THEREOF

CROSS-REFERENCE TO RELATED APPLICATIONS

This application claims the benefit of U.S. Provisional Application No. 61/648,469, filed on May 17, 2012, entitled "Wireless Communication Device with a Multiband Antenna, and Methods of Making and Using Thereof," which application is hereby incorporated herein by reference.

TECHNICAL FIELD

The present disclosure relates to a device and method for wireless communications, and, in particular embodiments, to a wireless communication device with multiple-band antennas, and methods of making and using thereof.

BACKGROUND

Wireless devices provide connections to multiple wireless networks in multiple and varied frequency bands by means of antenna(s). This requires multiband antennas that can be used in multiple frequency bands. An antenna is a medium for transmitting and receiving electromagnetic waves. These days' consumer wireless handheld devices are getting thinner and more compact; this in turn calls for a size reduction for most of the components including the antenna. On the other hand more and more communication protocols using different frequency bands are being added. As more frequency bands (larger bandwidths) need to be supported, a larger antenna volume is desired. As you can see both the statements above are contradicting and it is a challenge to satisfy all the requirements. However, achieving a wide low band bandwidth separately or in conjunction with an ultra wide high band has been very challenging if not impossible using a passive antenna in the past, especially in ultra slim and small portable wireless devices. Cellular portable devices available in the market today that cover a wide low band bandwidth generally use one of two approaches. One approach uses some type of active solution (e.g., radio frequency (RF) switch, tunable capacitors and so on) to tune the resonance frequency depending on the band usage at a given point. Disadvantages of this solution include added cost and complexity, more discrete components are required, increased complexity from a software perspective, and increased losses in the RF chain.

Another approach is to split the low band section into two antennas (e.g., one at the bottom and one at the top). The antenna at the bottom covers the 850/900 bands and the antenna at the top covers the 700 band). A disadvantage of this solution is that two antennas need more real estate in an already very crowded small portable device. Furthermore, the device is more expensive and complex from the point of having two separate radiators, feeding clips, matching components, coaxial cable, etc. Also, if one of the transmitting antennas is placed at the top of the handset, this might cause specific absorption rate (SAR) issues that may be very hard to resolve.

Therefore, there is an opportunity to develop very wide bandwidth multiband internal antennas that are compact.

SUMMARY

An embodiment antenna for a wireless device includes a meander structure formed from a plurality of meanders and a conductive strip connected in parallel to the meander structure and including a plurality of tabs projecting toward the meander structure, a first group of tabs connected to a first group of meanders corresponding to the first group of tabs, a second group of tabs disconnected from a second group of meanders corresponding to the second group of tabs.

An embodiment wireless device includes a transceiver, a finite ground plane, and an antenna connected to the transceiver through a feed section and to the finite ground plane through a ground section, the antenna including a meander structure and conductive strip connected in parallel, the meander structure formed from a plurality of meanders, the conductive strip including a plurality of tabs projecting into the meanders corresponding to the tabs.

An embodiment method of forming a wireless device includes forming a meander structure with a plurality of meanders, forming a conductive strip having a plurality of tabs, and connecting the conductive strip to the meander structure in parallel, the tabs of the conductive strip projecting toward the meander structure such that a first group of tabs is connected to a first group of meanders corresponding to the first group of tabs and a second group of tabs is disconnected from a second group of meanders corresponding to the second group of tabs.

BRIEF DESCRIPTION OF THE DRAWINGS

For a more complete understanding of the present disclosure, and the advantages thereof, reference is now made to the following descriptions taken in conjunction with the accompanying drawing, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present disclosure provides many applicable inventive concepts that can be embodied in a wide variety of specific contexts. The specific embodiments discussed are merely illustrative and do not limit the scope of the disclosure.

An embodiment includes multiband antennas for electronic devices, such as portable wireless communication devices. An embodiment wideband/broadband antenna design provides coverage from 690 MHz-960 MHz over the various communication protocols such as: LTE Band XVII, Band XIII, GSM850, GSM900, UMTS Band5, Band XII, Band8 for the low bands, as well as 1700 MHz-3000 MHz (LTE Band IV, Band2/1/4/41, DCS 1800, PCS 1900) or 1400 MHz to 2700 MHz (Band XI, Band 41) for the high bands, depending on the mode of antenna optimization and tuning. While specific frequency bands are listed because they are being used currently for wireless communications, embodiments are not in any way limited to only these bands, and any other bands that are implemented by these or other standards or devices are within the scope of various embodiments.

Figure 1:
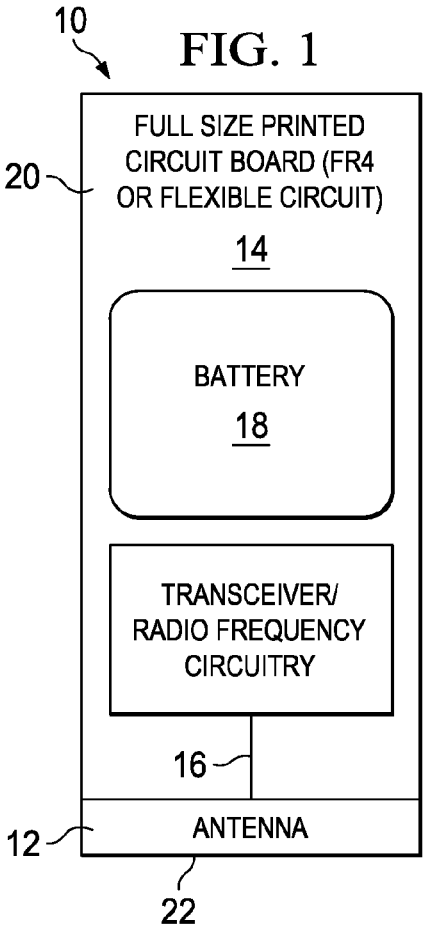
FIG. 1 illustrates a module layout for an embodiment wireless device.

Referring now to FIG. 1, a module layout for an embodiment wireless device 10 having a multiband wideband antenna 12 is shown. In an embodiment, the antenna 12 is coupled to a full size printed circuit board 14 using a transmission line 16. Multiple multiband antennae may be connected to this circuit board via separate transmission lines. The circuit board 14 may be formed using a fiberglass reinforced epoxy (FR4), polyimide, and so on. This circuit board may have multiple layers and one of the layers will serve as the reference ground plane for the PCB. As shown, the circuit board 14 may include a transceiver, LCD, camera modules, and other radio frequency (RF) circuitry. In an embodiment, the feed section of the antenna 12 is connected to a Front End Module, a transceiver, and/or matching circuitry on the circuit board 14 by means of a coaxial cable or transmission line 16. The circuit board 14 is also coupled to a battery and/or other wireless device components 18. In an embodiment, a ground leg for the antenna 12, which is hidden beneath the antenna 12 in FIG. 1, is connected to the finite ground plane of the printed circuit board 14, either directly or indirectly.

Figure 2:
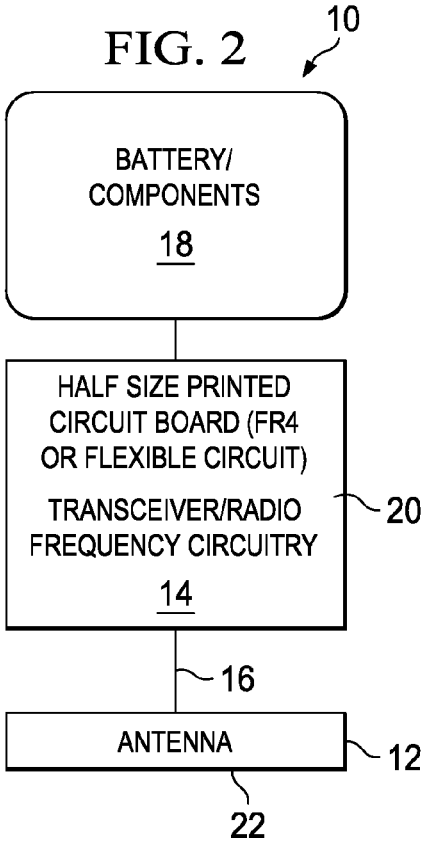
FIG. 2 illustrates an alternative module layout for an embodiment wireless device.

As shown in FIG. 1, the antenna 12 may be disposed proximate a bottom 22 of the wireless device 10 and the circuit board 14 may be approximately the size of the wireless device 10. In this configuration, the battery and other components 18 are placed on the circuit board 14. However, the various components and devices of the wireless device 10 may be otherwise located in other embodiments. For example, an alternative module layout for the wireless device 10 is shown in FIG. 2. In FIG. 2, the battery and other components 18 and a half size printed circuit board 14 layout has been illustrated.

Figure 3:
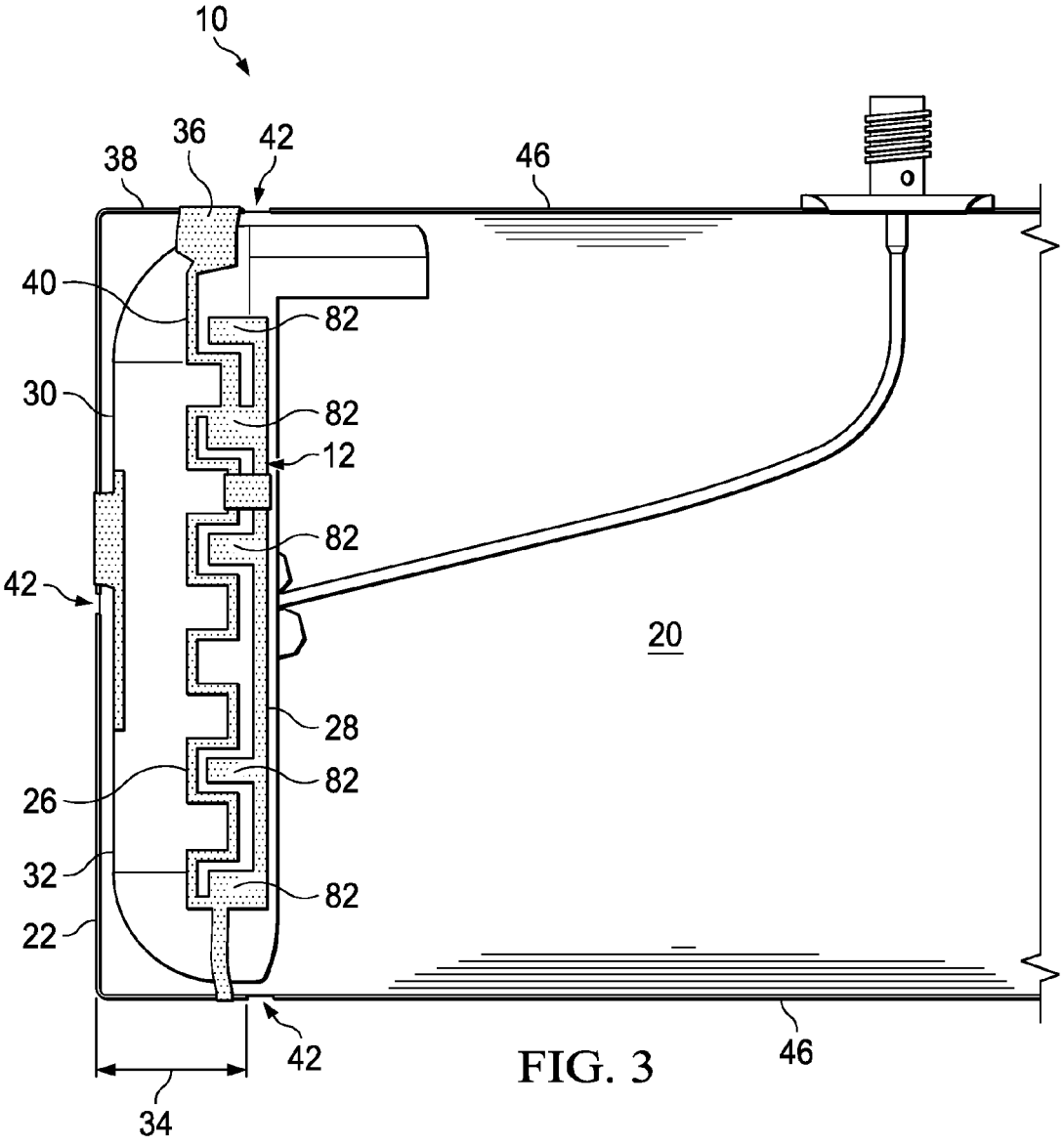
FIG. 3 illustrates an embodiment antenna aligned with a full metal frame.

Referring now to FIG. 3, a representative portion of an embodiment wireless device 10 (with the battery/components 18 removed) is illustrated. This embodiment illustrates how this antenna design can be incorporated into a wireless device with a complete metal ring surrounding it. The representative portion of the wireless device 10 depicts the antenna 12 of FIGS. 1-2 in greater detail. As shown, the antenna 12 includes a meander structure 26 of any shape, e.g., square or sine wave, connected in parallel to a conductive strip 28. As used herein, parallel includes both parallel and substantially parallel. The antenna 12 generally includes a feed section 30, and a ground section 32, which is coupled to the ground plane of the PCB 14. As shown, the feed section 30 and the ground section 32 are generally coupled to opposing ends of the antenna 12. The feed and ground sections can be swapped.

In an embodiment, the feed section 30 is coupled to the meander structure 26 at one end of the antenna 12 and the ground section 32 is coupled to the conductive strip 28 at an opposing end of the antenna 12. In an embodiment, a ground clearance 34 of the antenna 12, which is measured from a peripheral end of the ground plane 20 to the periphery of the feed and ground sections 30, 32 as shown in FIG. 3, is ten millimeters (10 mm). However, this value may be higher or lower in other embodiments.

The meander structure 26 and the conductive strip 28 of the antenna 12 are placed very close to each other to increase electro-magnetic coupling. This coupling helps in making the antenna 12 resonate at a particular frequency. In an embodiment, a patch 36 is placed on the feed arm 38 of the feed section 30 of the antenna 12, making the design asymmetric. The placing of the patch 36 on the feed arm 38 of the feed section 30 helps in considerably widening the low band bandwidth of the antenna 12. Indeed, the patch 36 creates very strong electro-magnetic coupling between a first meander 40 (e.g., the first U-shape in the meander structure 26) and the feed arm 38.

Figure 4A:
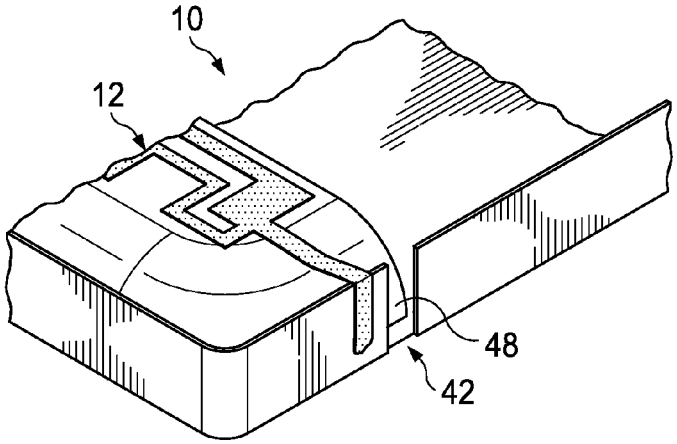
FIG. 4 illustrates a location of slots formed between the antenna and full metal frame of FIG. 3 and between a feed section and a ground section of the antenna.
Figure 4B:
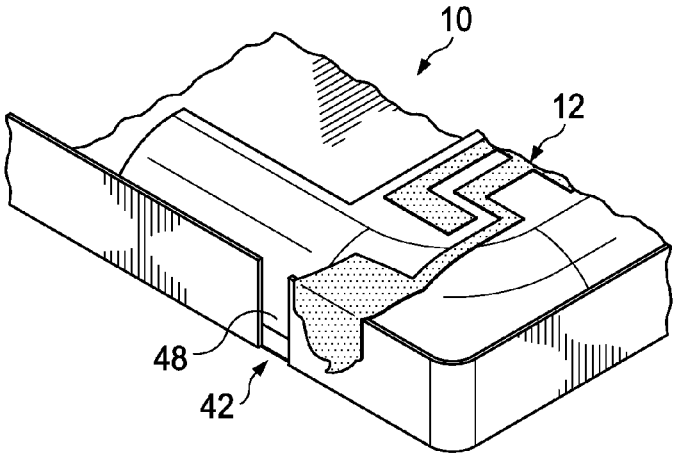
Figure 4C:
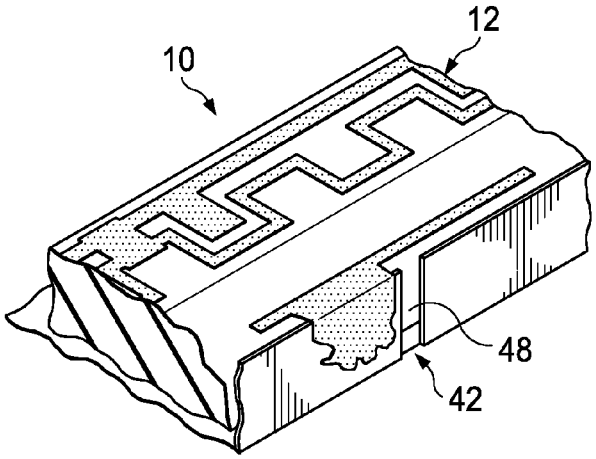

Still referring to FIG. 3, the wireless device 10 can include a full PCB used in conjunction with the antenna 12. This PCB might be single layer or multiple layers. One of the layers will serve as the reference finite ground plane for the antenna. The PCB is generally aligned with the feed and ground sections 30, 32 of the antenna 12 depicted in FIG. 3. The ground section/leg of the antenna is connected to the finite ground plane directly or indirectly. In an embodiment as shown in FIGS. 4*a*-4*c*, the wireless device 10 includes or forms three slots 42. Two of the slots 42, which are symmetrical, are disposed on opposing sides 46 of the wireless device 10. The other slot 42 is disposed at the bottom 22 and in the middle of the wireless device 10. In an embodiment, the slots 42 may be otherwise located or formed. In addition, more or fewer slots 42 may be used in other embodiments. As shown in FIGS. 4*a*-4*c*, an insulator 48 (e.g., a plastic block, etc.) is used to break electrical connection at the slots 42.

Figure 5:
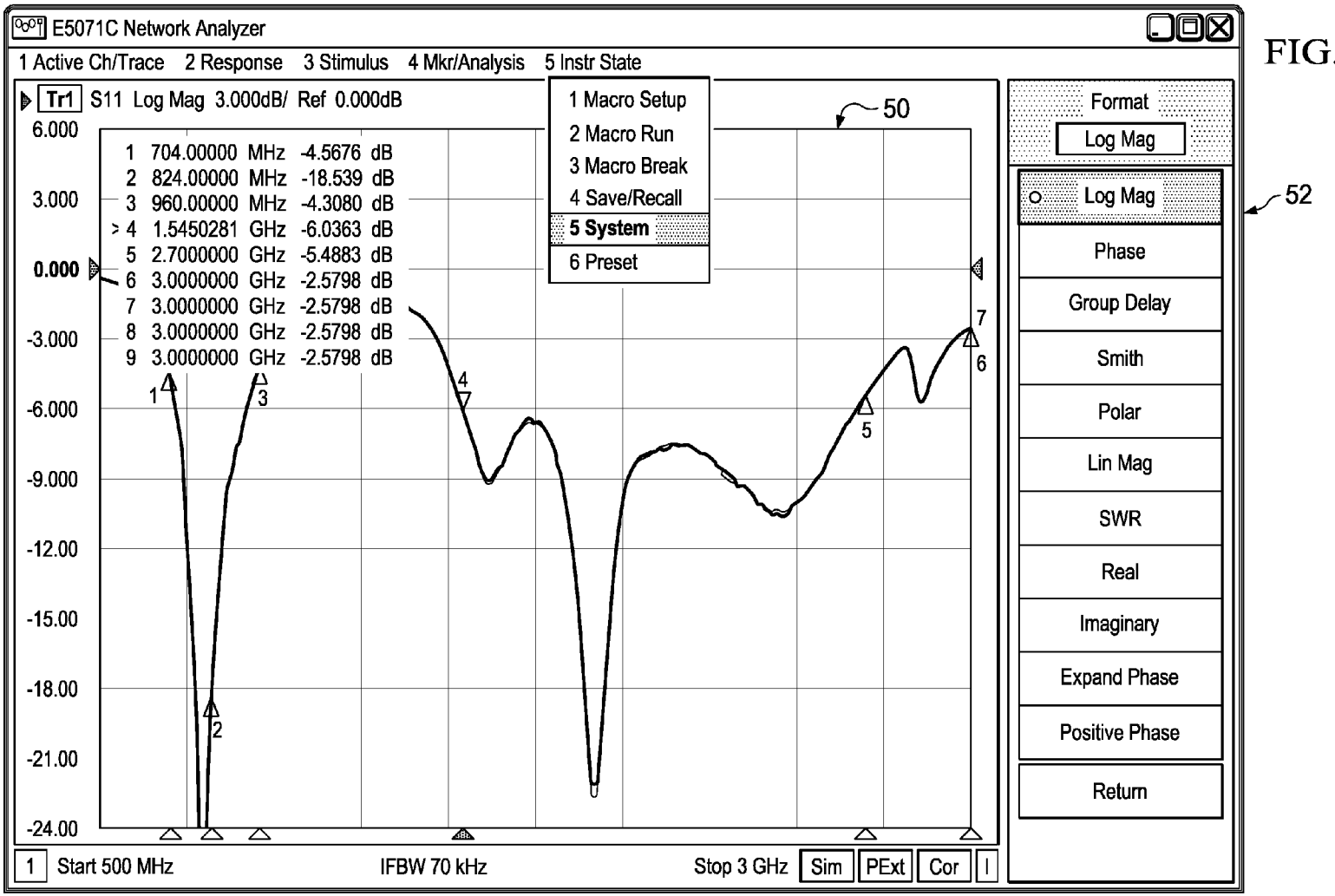
FIG. 5 illustrates a return loss plot for the antenna of FIG. 3.
Figure 6:
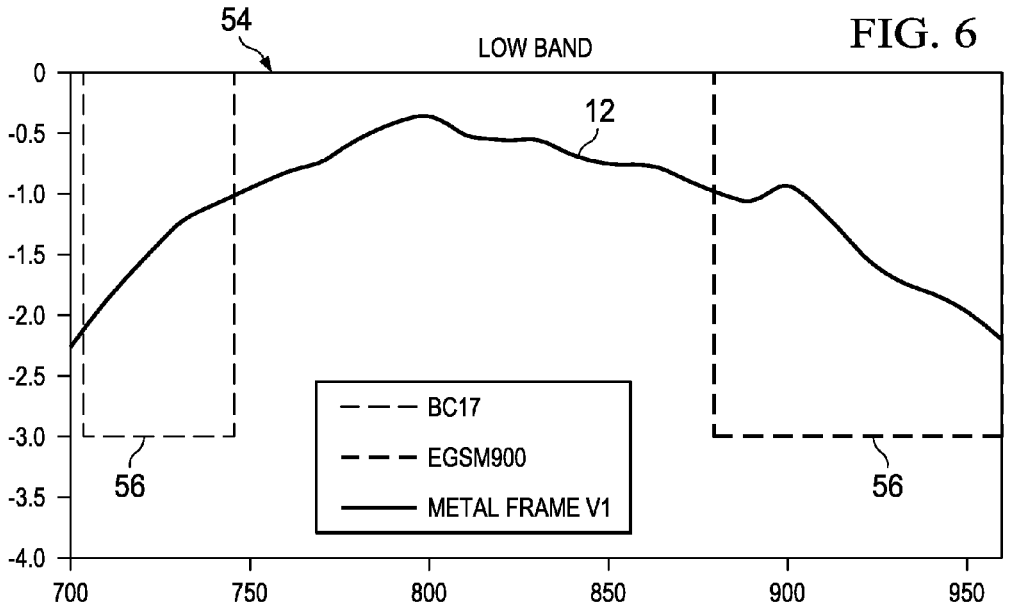
FIG. 6 illustrates low band antenna efficiency for the antenna of FIG. 3.
Figure 7:
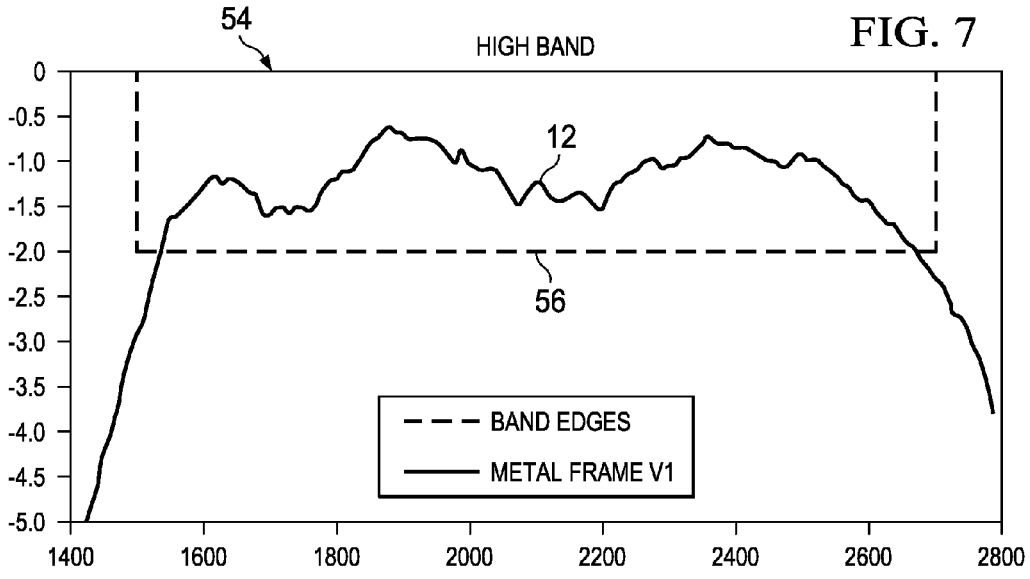
FIG. 7 illustrates high band antenna efficiency for the antenna of FIG. 3.

Referring now to FIG. 5, a return loss plot 50 for the antenna 12 of FIG. 3 is graphically illustrated. As shown, the frequency range 52 (along the horizontal axis) covered for low band is in a range of about 690 MHz to about 960 MHz and for high band is in a range of about 1500 to about 2700 MHz (or 3 GHz). Thus, the antenna concept 12 shown in FIG. 3 can support communications in a plurality of frequency bands. FIG. 6 illustrates low band antenna efficiency 54 of the embodiment antenna 12 of FIG. 3. By looking at the band edges 56 one can say that efficient antenna performance for the desired frequency of operation is obtained. FIG. 7 illustrates high band antenna efficiency 54 for the embodiment antenna 12 of FIG. 3. By looking at the band edges 56 one can say that efficient antenna performance for the desired frequency of operation is obtained.

Figure 8:
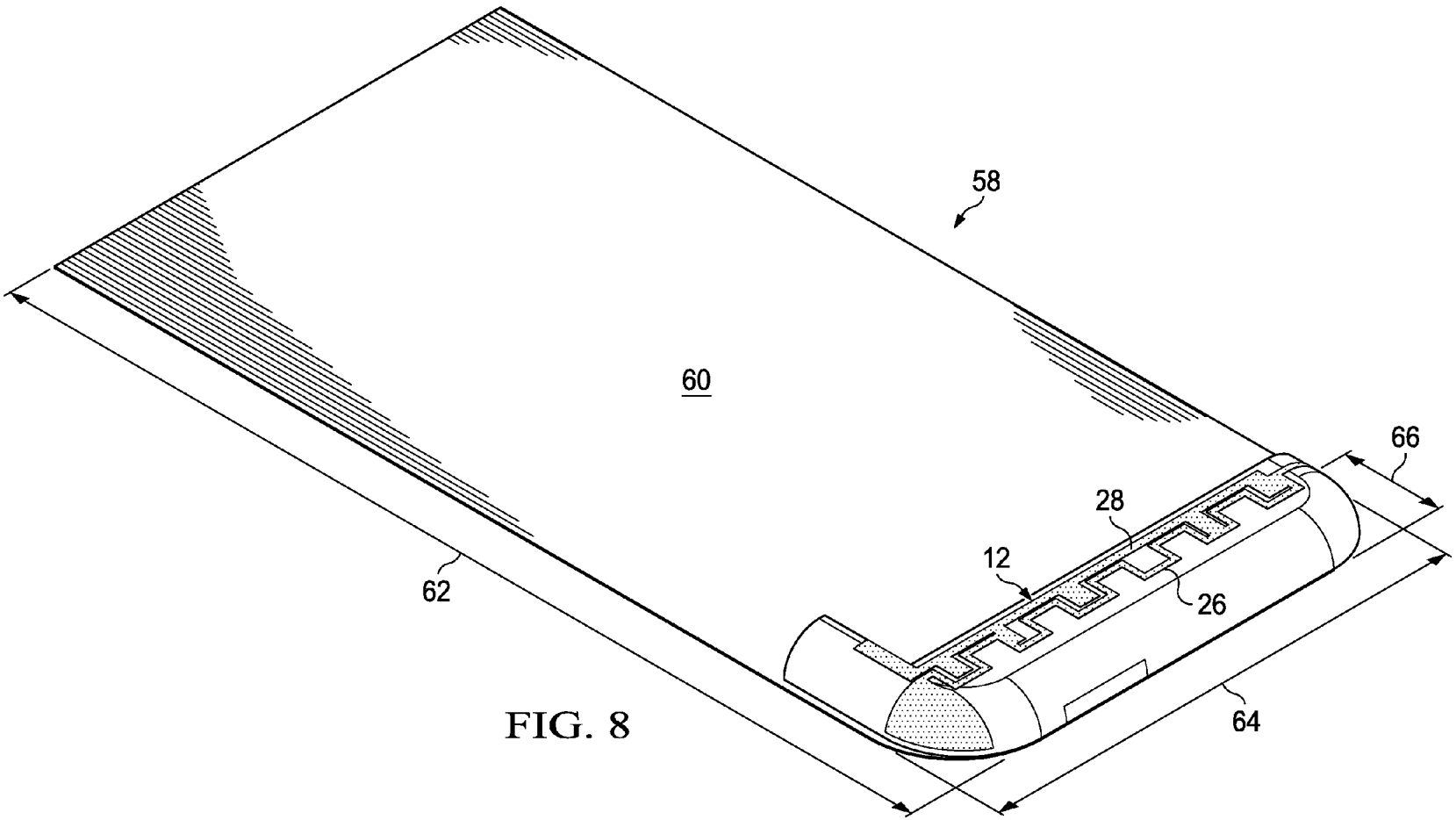
FIG. 8 illustrates a second embodiment antenna aligned with and supported by a plastic antenna carrier.

Referring now to FIG. 8, an embodiment wireless device 58 having a plastic (e.g., polycarbonate/acrylonitrile butadiene styrene (PC/ABS)) frame 60 around or supporting the antenna 12 is illustrated. This embodiment illustrates how this antenna design can be incorporated into a wireless device with a polycarbonate/acrylonitrile butadiene styrene (PC/

ABS) frame surrounding it. In an embodiment, the PCB/finite ground plane has a length 62 of about 129 mm and a width 64 of about 64 mm. Even so, in other embodiments the PCB supported by the frame 60 may have larger or smaller dimensions. In an embodiment, a ground clearance 66 of the antenna 12 is 10 mm. However, this value may be higher or lower in other embodiments. As shown, the wireless device 58 shares many of the same features and structures of the wireless device 10 and, therefore, those items have not been described again in detail.

Figure 9:
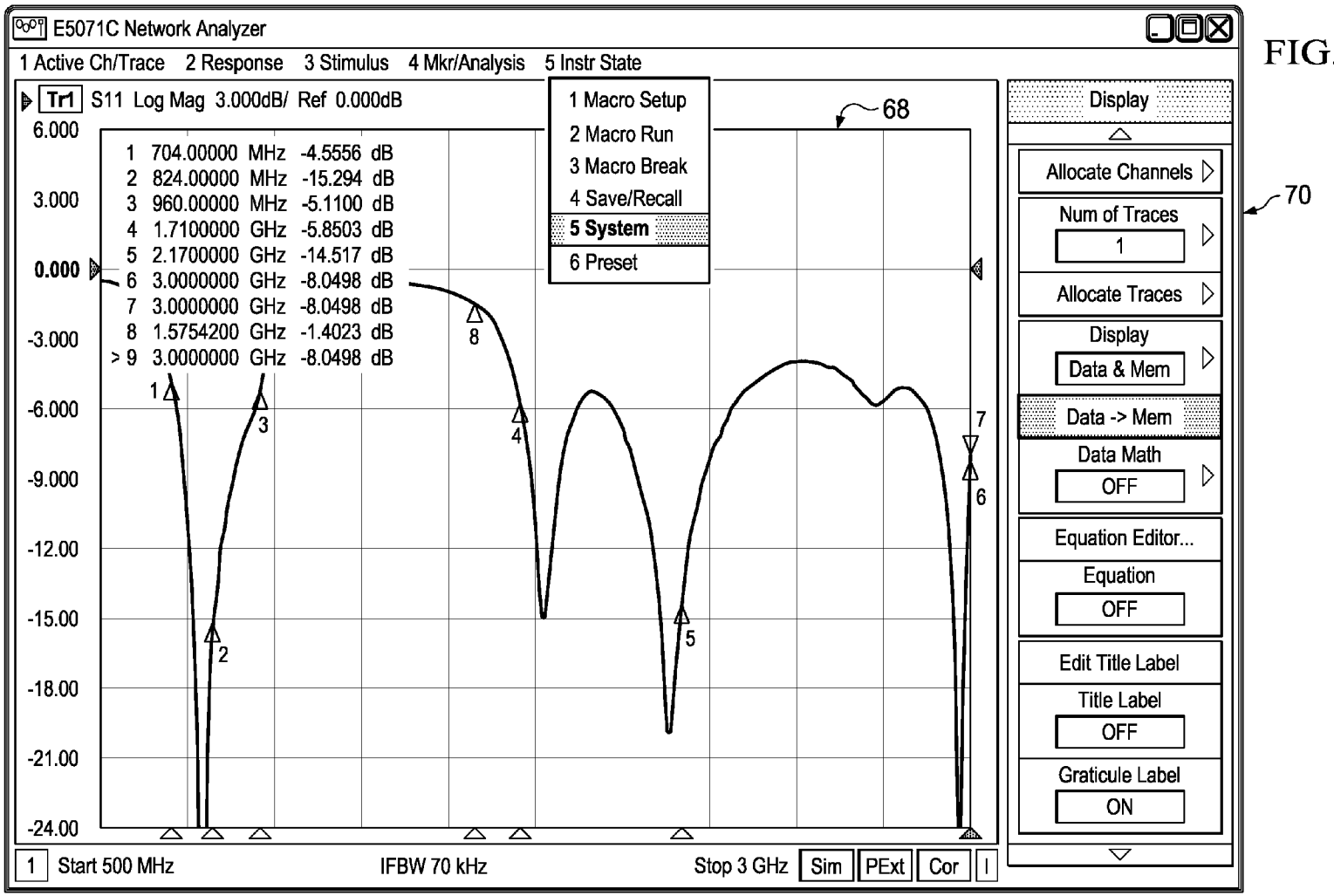
FIG. 9 illustrates a return loss plot for the antenna of FIG. 8.
Figure 10:
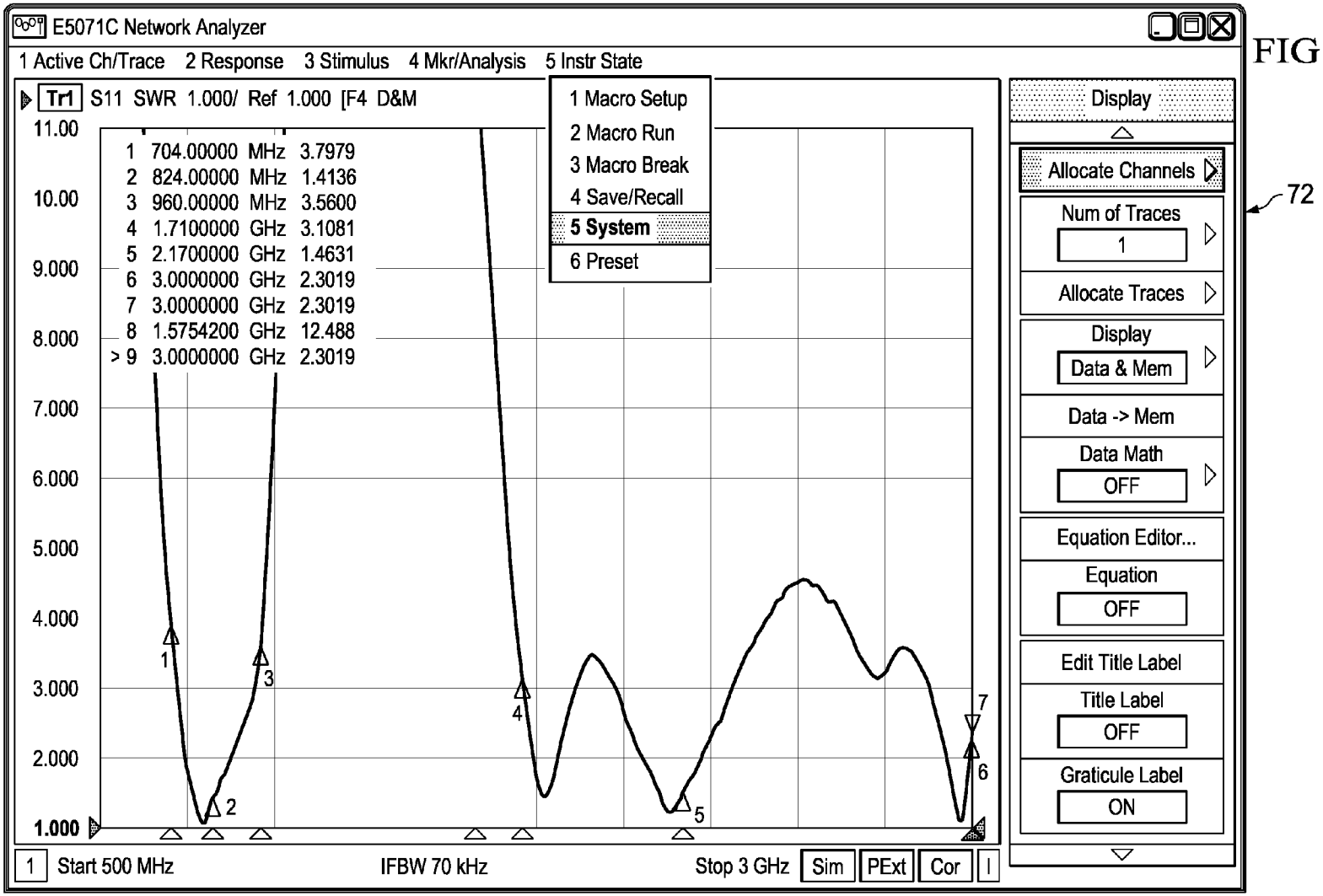
FIG. 10 illustrates a plot of voltage standing wave ratio (VSWR) vs. operating frequency for the antenna of FIG. 8.
Figure 11:
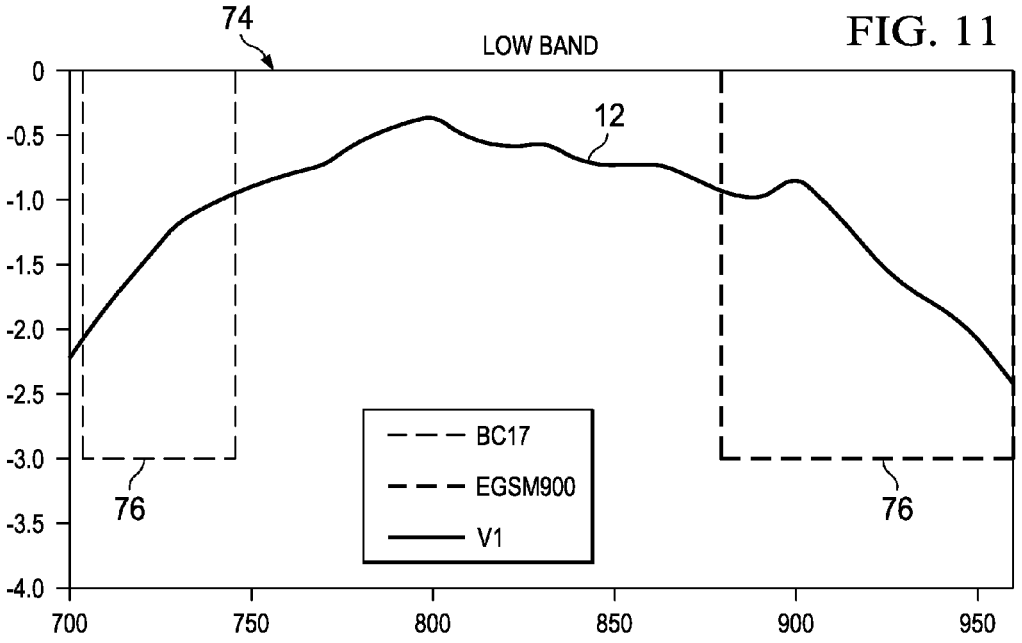
FIG. 11 illustrates low band antenna efficiency for the antenna of FIG. 8.
Figure 12:
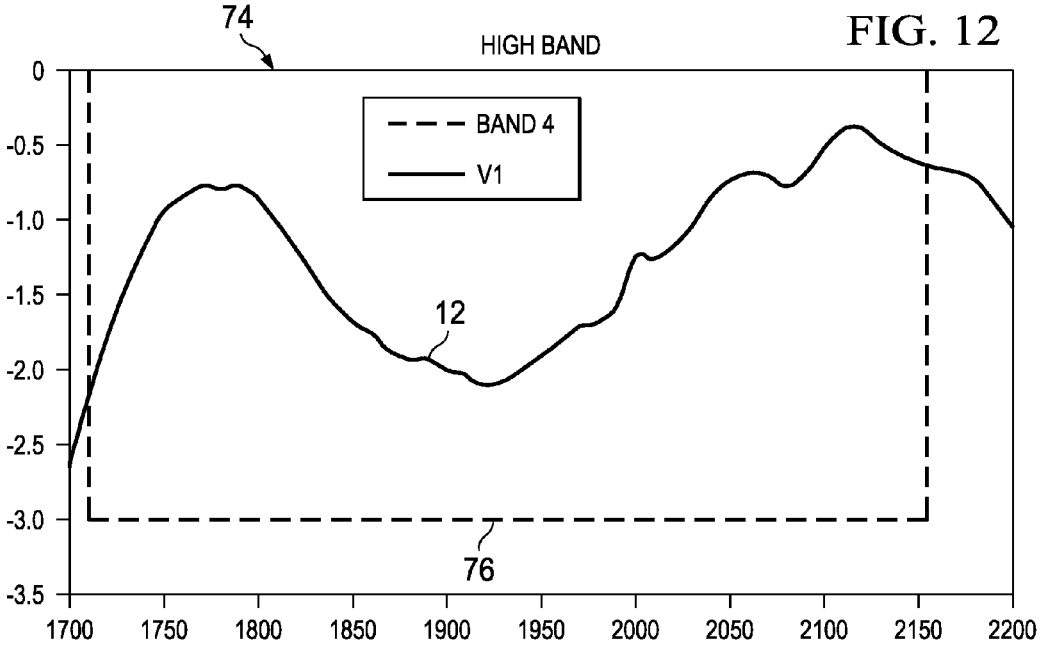
FIG. 12 illustrates high band antenna efficiency for the antenna of FIG. 8.

Referring now to FIG. 9, a return loss plot 68 for the antenna 12 of FIG. 8 is graphically illustrated. As shown, the frequency range 70 covered for low band is in a range of about 690 MHz to about 960 MHz and for high band is in a range of about 1700 to about 2300 MHz. Thus, the antenna concept 12 shown in FIG. 3 can support communications in a plurality of frequency bands. FIG. 10 illustrates a voltage standing wave ratio (VSWR) 72 for the antenna 12 of FIG. 8. In addition, FIG. 11 illustrates low band antenna efficiency 74 for the embodiment antenna 12 of FIG. 8. By looking at the band edges 76 one can say that efficient antenna performance for the desired frequency of operation is obtained for antenna 12 operating with the plastic frame 60 in the embodiment wireless device 58 of FIG. 8. FIG. 12 illustrates high band antenna efficiency 74 for the embodiment antenna 12 of FIG. 8. By looking at the band edges 74 one can say that efficient antenna performance for the desired frequency of operation is obtained for antenna 12 operating with the plastic frame 60 in the embodiment wireless device 58 of FIG. 8.

Figure 13:
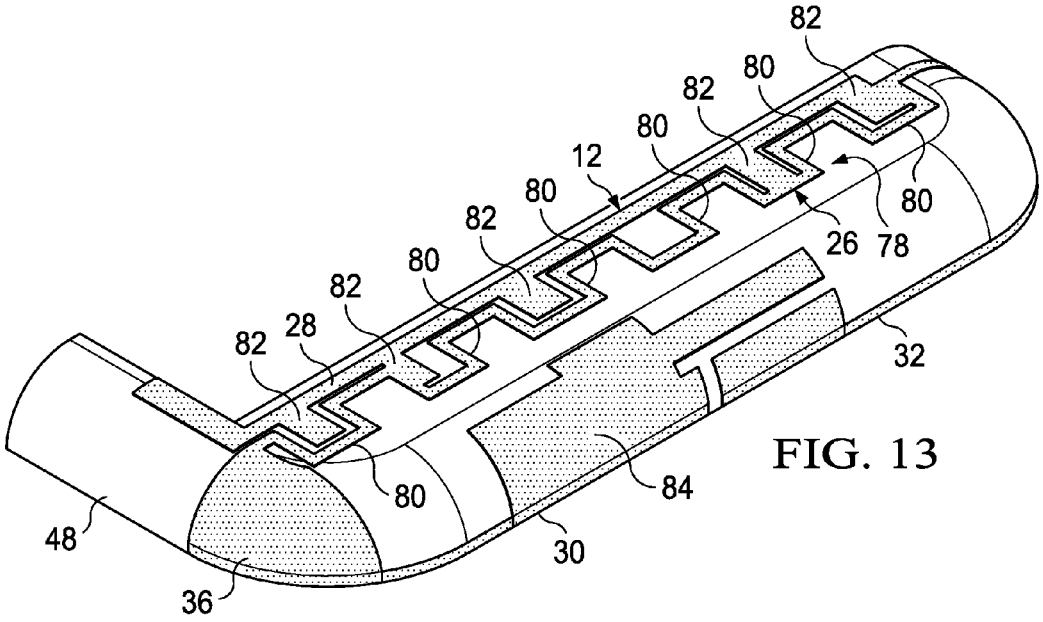
FIG. 13 illustrates a square wave pattern for a meander structure from the antenna of FIG. 3.

Referring now to FIG. 13, an embodiment antenna 12 with a square wave pattern 78 is illustrated. As shown, the antenna 12 includes the meander structure 26 and the conductive strip 28. The meander structure 26 includes six individual square wave-shaped meanders 80 joined together to form a continuous, uninterrupted path. However, more or fewer of the meanders 80 may be formed in other embodiments depending on desired frequency of operation. The conductive strip 28 includes five tabs 82 extending toward, and at times coupled to, the meander structure 26. More or fewer of the tabs 82, which may or may not be connected to the meander structure 26, may be formed in other embodiments.

In an embodiment, a first tab 82 (from left to right) projects into, but is not connected to, a first meander 80, a second tab 82 is connected to a left leg of a second meander 80, a third tab 82 projects into, but is not connected to a third meander 80, a fourth tab 82 projects into and is connected to a bottom of a fifth meander 80, and a fifth tab 82 is connected to a right leg of a sixth meander 80. In an embodiment, a fourth meander 80 is unfilled with any of the tabs 82. As shown, the second tab 82 is narrower than, for example, the first and third tabs 82. In other embodiments, different configurations may be employed for the antenna 12.

In an embodiment, a tuning structure 84 is coupled to the feed section 30 as shown in FIG. 13. The tuning structure 84 may be used to help the antenna 12 resonate at a desired or particular frequency.

Figure 14:
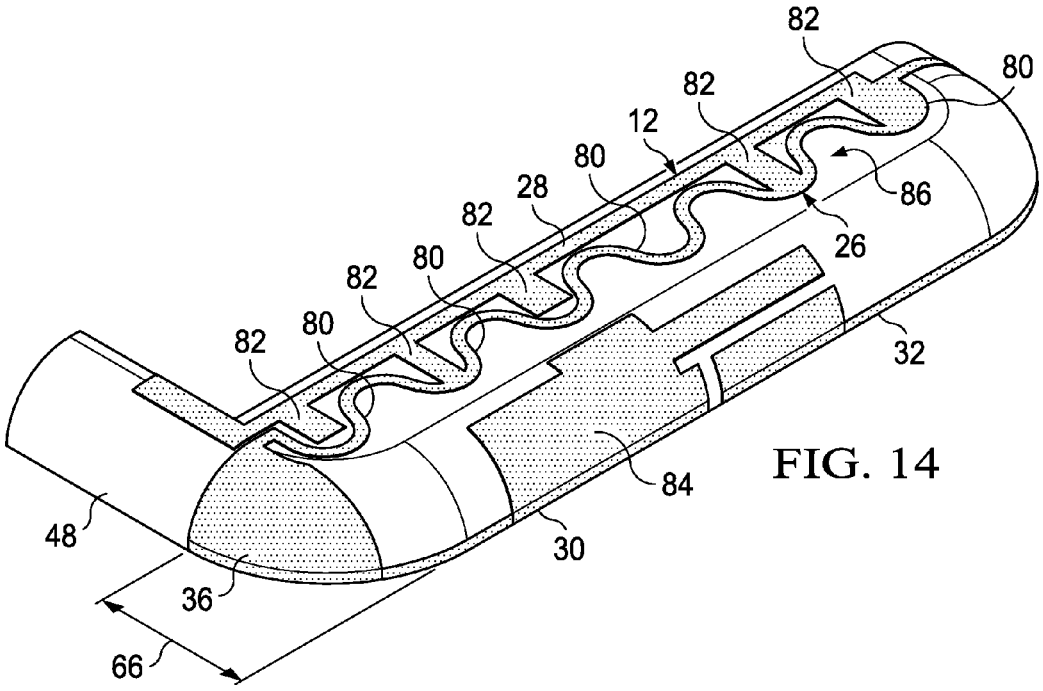
FIG. 14 illustrates a sine wave pattern for a meander structure from the antenna of FIG. 3.

FIG. 14 illustrates an embodiment antenna 12 having a sine wave meander pattern 86. As shown, the antenna 12 includes the meander structure 26 and the conductive strip 28. The meander structure 26 includes six individual U-shaped meanders 80, each of which has a rounded bottom. However, more or fewer of the meanders 80 may be formed in other embodiments. The conductive strip 28 includes five tabs 82 extending toward, and at times coupled to, the meander structure 26. More or fewer of the tabs 82, which may or may not be connected to the meander structure 26, may be formed in other embodiments.

In an embodiment, a first tab 82 (from left to right) projects into, but is not connected to, a first meander 80, a second tab 82 is connected to a bottom of a second meander 80, a third tab 82 projects into, but is not connected to a third meander 80, a fourth tab 82 projects into and is connected to a bottom of a fifth meander 80, and a fifth tab 82 is connected to a right leg of a sixth meander 80. In an embodiment, a fourth meander 80 is unfilled with one of the tabs 82. As shown, the second tab 82 is narrower than, for example, the first and third tabs 82. In other embodiments, different configurations may be employed for the antenna 12.

Figure 15:
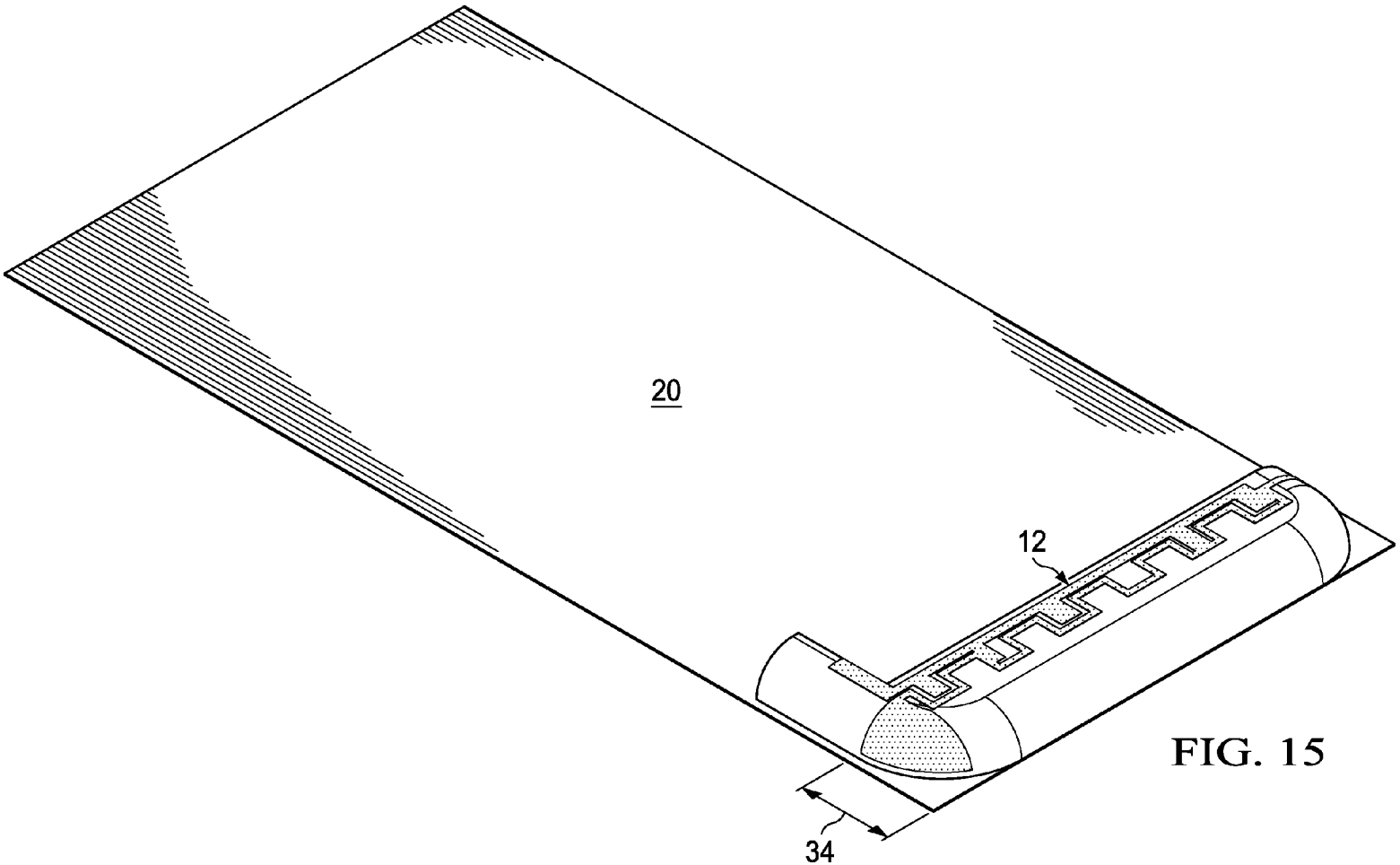
FIG. 15 illustrates an embodiment antenna oriented relative to a finite ground plane and an antenna ground clearance.

FIG. 15 illustrates an embodiment antenna 12, the finite ground plane 20, and the antenna ground clearance 34 disposed at an end of the finite ground plane 20 below the antenna 12.

From the foregoing, it should be recognized that an embodiment ultra wideband multiband antenna incorporates both low band and high band broad banding techniques. An embodiment antenna provides ultra wide bandwidth in a compact antenna volume. An embodiment device has one antenna providing coverage for, e.g., eight or nine cellular bands of operation without any increase in antenna volume, when real estate comes at a very high price in today's slim/compact wireless devices.

An embodiment antenna has enhanced low and high bandwidth that translates directly into cost savings per device, reduced number of stock-keeping units (SKUs), etc. An embodiment does not increase cost or software complexity, as the performance is achieved by a true passive solution. An embodiment provides significant cost savings over existing active solutions in the market. In an embodiment, the location of the antenna in a device provides a low risk of SAR.

Embodiments may be applied to wireless communication devices that have multiband operation, such as but not limited to cell phones, tablets, net books, laptops, e-readers, etc. Embodiments may be applied to electronic devices that use one or more antennas, such as a mobile terminal, infrastructure equipment, GPS navigation devices, desktop computers, etc.

In a comparison of embodiment antennas with a typical prior art device, the prior art device has a narrow low band bandwidth with the same antenna volume (dimensions): 140 MHz coverage (824 MHz-960 MHz), for GSM850/EGSM900. The high band bandwidth realized is 1710 MHz-2170 MHz, for DCS1800/PCS1900/Band I/AWS. Multiple SKUs/antenna versions, e.g., U.S., E.U, Japan, are required for different versions of the handset because the antennas are bandwidth limited. An active matching network is required, which increases cost and complexity from both hardware and software points of view. Two antennas may be required to cover the required frequency bands. This also increases cost and real estate on a PCB.

In contrast, in an embodiment, wide low band bandwidth is provided without any increase in antenna volume (dimensions): 270 MHz coverage (690 MHz-960 MHz), for GSM850/EGSM900/Band 17. The wide high band bandwidth realized is 1500 MHz-3000 MHz. In an embodiment, one antenna design can be optimized to cover all the bands required. There is no need for an active matching network, which keeps the front end simple and provides a large cost reduction.

While the disclosure provides illustrative embodiments, this description is not intended to be construed in a limiting sense. Various modifications and combinations of the illustrative embodiments, as well as other embodiments, will be apparent to persons skilled in the art upon reference to the description. It is therefore intended that the appended claims encompass any such modifications or embodiments.

What is claimed is:

1. An antenna for a wireless device, comprising:

a meander structure formed from a plurality of meanders, wherein the plurality of meanders comprises a first group of meanders and a second group of meanders; and a conductive strip connected in parallel to the meander structure and including a plurality of tabs projecting toward the meander structure, wherein the plurality of tabs comprises a first group of tabs and a second group of tabs, wherein a first group of tabs is connected to a first group of meanders corresponding to the first group of tabs, wherein each tab in the first group of tabs is directly connected to a respective meander in the first group of meanders, and wherein a second group of tabs is not directly connected to a second group of meanders corresponding to the second group of tabs.

2. The antenna of claim 1, wherein a first meander in the second group of meanders is connected to a patch, the patch connected to a feed section configured to receive a feed signal from a transceiver.

3. The antenna of claim 1, wherein a first meander in the first group of meanders is connected to a ground section, the ground section configured to connect to a ground plane.

4. The antenna of claim 1, wherein the plurality of meanders collectively forms a square wave pattern.

5. The antenna of claim 1, wherein at least one of the tabs in the first group of tabs is connected to at least one of a sidewall of one of the first group of meanders and a bottom of one of the first group of the meanders.

6. The antenna of claim 1, wherein at least one of the meanders is completely unfilled by any of the tabs.

7. The antenna of claim 1, wherein the first group of tabs includes at least two of the solid center tabs and the second group of tabs includes at least two of the tabs.

8. The antenna of claim 1, wherein at least one of the solid center tabs in the first group of tabs is narrower than another of the tabs in the first group of tabs.

9. The antenna of claim 1, wherein the meander structure and the conductive strip are each supported by an antenna carrier, the antenna carrier formed from a non-metallic material.

10. The antenna of claim 1, wherein the meander structure is connected to a feed section, the feed section supporting a tuning structure configured to manipulate a resonant frequency.

11. A wireless device comprising:

a transceiver;

a finite ground plane; and an antenna connected to the transceiver through a feed section and to the finite ground plane through a ground section, the antenna including a meander structure and conductive strip connected in parallel, the meander structure formed from a plurality of meanders, wherein the plurality of meanders comprises a first group of meanders and a second group of meanders, the conductive strip including a plurality of tabs projecting into the meanders corresponding to the tabs, wherein the plurality of tabs comprises a first group of tabs and a second group of tabs, wherein a first group of tabs is connected to a first group of meanders corresponding to the first group of tabs, wherein each tab in the first group of tabs is directly connected to a respective meander in the first group of meanders, and wherein a second group of tabs is not directly connected to a second group of meanders corresponding to the second group of tabs.

12. The device of claim 11, wherein the antenna is connected to the transceiver through the feed section using a patch, the patch making the antenna asymmetrical.

13. The device of claim 11, wherein the meander structure forms a square wave pattern.

14. The device of claim 11, wherein the feed section and the ground section are separated by a slot occupied by an insulator.

15. The device of claim 11, further comprising a tuning structure connected to the feed section, the tuning structure configured to alter a resonant frequency of the antenna.

16. A method of forming an antenna for a wireless device, comprising:

forming a meander structure with a plurality of meanders, wherein the plurality of meanders comprises a first group of meanders and a second group of meanders;

forming a conductive strip having a plurality of tabs, wherein the plurality of tabs comprises a first group of tabs and a second group of tabs; and connecting the conductive strip to the meander structure in parallel, the tabs of the conductive strip projecting toward the meanders corresponding to the first group of tabs, wherein each tab in the first group of tabs is directly connected to a respective meander in the first group of meanders, and such that a second group of tabs is not directly connected to a second group of meanders corresponding to the second group of tabs.

17. The method of claim 16, further comprising forming the meander structure to resemble a square wave pattern.

18. The method of claim 16, further comprising coupling a feed section to one end of the meander structure and a ground section to an opposing end of the meander structure.

19. The method of claim 18, further comprising separating the feed section and the ground section with a slot occupied by an insulator.

20. The method of claim 19, further comprising coupling a patch to a first meander of the meander structure and an end of the feed section proximate the first meander.

21. The method of claim 16, further comprising forming the meander structure to resemble a sine wave pattern.

22. The antenna of claim 1, wherein the plurality of meanders collectively forms a sine wave pattern.

23. The device of claim 11, wherein the meander structure forms a sine wave pattern.

* * * * *

UNITED STATES PATENT AND TRADEMARK OFFICE

CERTIFICATE OF CORRECTION

PATENT NO. : 9,178,270 B2
APPLICATION NO. : 13/604521
DATED : November 3, 2015
INVENTOR(S) : Kiran Vanjani It is certified that error appears in the above-identified patent and that said Letters Patent is hereby corrected as shown below:

In the Claims:

In Col. 7, line 35, claim 7, delete "solid center".

Signed and Sealed this
Twenty-second Day of March, 2016

Michelle K. Lee

Michelle K. Lee
*Director of the United States Patent and Trademark Office*